US005535835A

United States Patent [19]

Walker

[11] Patent Number: 5,535,835

[45] Date of Patent: Jul. 16, 1996

[54] STRAIGHT/DIRECTIONAL DRILLING DEVICE

[75] Inventor: Colin Walker, Winster, England

[73] Assignee: Baroid Technology, Inc., Houston, Tex.

[21] Appl. No.: 341,547

[22] PCT Filed: May 18, 1993

[86] PCT No.: PCT/GB93/01011

§ 371 Date: Feb. 9, 1995

§ 102(e) Date: Feb. 9, 1995

[87] PCT Pub. No.: WO93/23652

PCT Pub. Date: Nov. 25, 1993

[30] Foreign Application Priority Data

May 21, 1992 [GB] United Kingdom ..... 9210846

[51] Int. Cl.[6] ..... E21B 7/00; E21B 34/12

[52] U.S. Cl. ..... 175/73; 175/76; 175/107

[58] Field of Search ..... 175/61, 73, 74, 175/75, 76, 107, 256

[56] References Cited

U.S. PATENT DOCUMENTS 4,143,722 3/1979 Driver ..... 175/73 X 4,492,276 1/1985 Kamp ..... 175/107 X 4,667,751 5/1987 Geczy et al. ..... 175/76 X 5,311,953 5/1994 Walker ..... 175/107 X

*Primary Examiner*—David J. Bagnell

*Attorney, Agent, or Firm*—Browning, Bushman, Anderson & Brookhart

[57] ABSTRACT

Apparatus for steering a drill bit at the end of a drill string within the borehole to selectively effect drilling along either a curved path or a substantially straight path comprises a first downhole motor assembly coupled to the drill bit and operable to rotate the drill bit to effect drilling, the assembly being arranged to angularly tilt the rotational axis of the drill bit relative to the axis of the section of the borehole being drilled, and a second downhole motor coupled to the first motor assembly to the drill string and operable to rotate the first motor assembly. In addition the apparatus includes a lock sub which is selectively actuable to (i) effect rotation of the drill bit by the first motor assembly while the first motor assembly is maintained at a defined axial orientation so as to cause drilling of the borehole along a curved path in the direction of tilt of the drill bit, or (ii) effect rotation of the drill bit by the first motor assembly while the first motor assembly is rotated by the second motor assembly so as to cause drilling of the borehole along a substantially straight path. Rotation of the drill string as a whole is not required to effect drilling in either mode.

10 Claims, 3 Drawing Sheets

STRAIGHT/DIRECTIONAL DRILLING DEVICE

Figure 1:
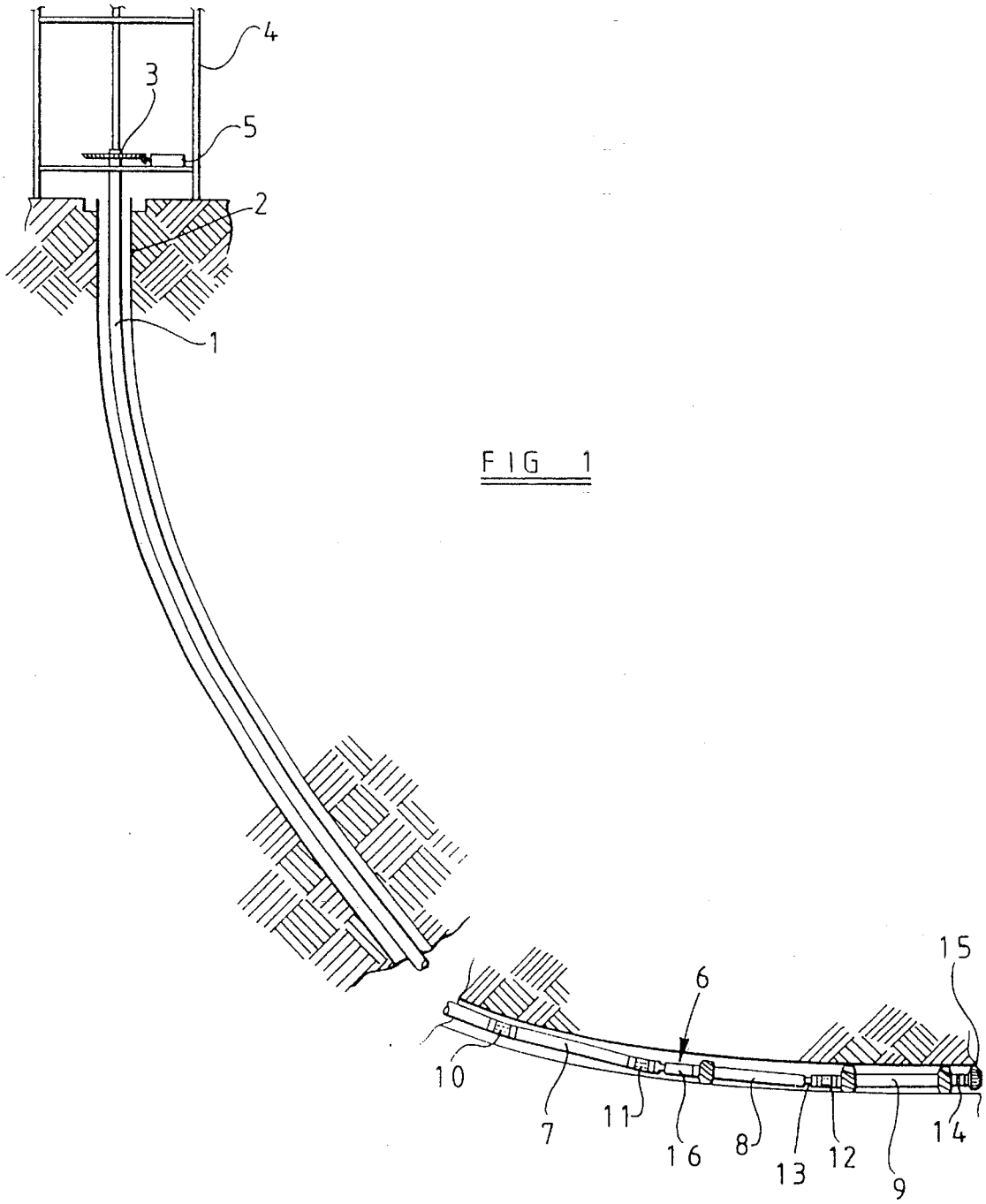

This invention relates to the steering of a drill bit at the end of a drill string within a borehole to selectively effect drilling along either a curved path or a substantially straight path.

It is known to drill a section of borehole along a deviated path so as to effect a change in trajectory of the borehole by use of a downhole trajectory control device which causes the drill bit located at the end of the drill string to be tilted to cause drilling at an inclined angle with respect to the immediately preceding section of the borehole. A known trajectory control device of this type comprises a mud motor which is installed in the bottomhole assembly close to the drill bit and which is arranged to angularly tilt the rotational axis of the drill bit relative to the axis of the section of borehole being drilled, so that rotation of the drill bit at the end of the borehole results in drilling along a curved path provided that the drill string is maintained at a defined axial orientation.

In one such arrangement utilising a downhole motor, the motor is supported by first and second eccentric stabilisers which are axially spaced apart along the motor housing and axially offset relative to one another so as to impart the required tilt to the rotational axis of the drill bit. By turning of the drill string to cause rotation of the motor housing to a known orientation, which is indicated to the surface by a downhole steering system, and subsequently maintaining such orientation during rotation of the drill bit by the motor, deviated drilling may be effected in the required direction. Furthermore, for sections of borehole where a straight trajectory is required, continuous rotation of the motor housing during rotation of the drill bit by the motor will result in a mean position of the axis of rotation of the drill bit which is coincident with the axis of the section of borehole being drilled. Thus, by alternating intervals of continuous housing rotation with intervals in which the orientation between the axis of rotation of the drill bit and the borehole axis is fixed, the trajectory of the borehole can be controlled as required. However changes in trajectory cause stresses to be induced in the housings of the motor and downhole steering system, and this can lead to damage or excessive wear in the associated tubular elements, threaded connections and internal components.

Normally continuous rotation of the drill string is used to effect drilling along a straight path. However, in circumstances in which the curvature of the borehole would lead to fatigue failure due to the magnitude and number of cyclic stress reversals in the drill string, continuous oriented drilling is employed with the orientation being changed by 180° every few feet. This results in an extremely tortuous borehole path and therefore significantly increased drag. As a consequence, the total length of borehole which can be drilled is reduced and subsequent casing operations are made more difficult.

It is an object of the invention to provide steering apparatus which reduces the stress related problems identified above.

According to the present invention there is provided apparatus for steering a drill bit at the end of a drill string within a borehole to selectively effect drilling along either a curved path or a substantially straight path, the apparatus comprising a first downhole motor assembly for coupling to the drill bit and operable to rotate the drill bit to effect drilling, the first motor assembly being arranged to angularly tilt the rotational axis of the drill bit relative to the axis of the section of borehole being drilled, a second downhole motor assembly for coupling the first motor assembly to the drill string and operable to rotate the first motor assembly, and actuating means for selectively (i) effecting rotation of the drill bit by the first motor assembly while the first motor assembly is maintained at a defined axial orientation so as to cause drilling of the borehole along a curved path in the direction of tilt of the drill bit, or (ii) effecting rotation of the drill bit by the first motor assembly while the first motor assembly is rotated by the second motor assembly so as to cause drilling of the borehole along a substantially straight path.

The above described arrangement is advantageous in that it enables the borehole to be drilled along a curved path in order to increase the inclination angle of the section of borehole being drilled and subsequently along a straight path in order to continue drilling at a constant angle, without it being necessary either to withdraw the drill string from the borehole or to rotate the drill string continuously to effect straight drilling. The arrangement may be such that the drilling mode may be changed between curved drilling and straight drilling as many times as required in order to follow the required trajectory. Because such steering does not require rotation of the drill string as a whole, it is possible to substantially reduce the risk of fatigue failure due to cyclic stress reversals. Furthermore, because it is not necessary to employ continuous oriented drilling in which the orientation is changed by 180° every few feet, it is possible to effect drilling along a longer and/or more deviated path than would otherwise be possible.

In a preferred embodiment of the invention the first motor assembly incorporates a mud motor adapted to be driven by drilling mud passing along the drill string to rotate the drill bit. The first motor assembly may be of various forms, and may for example incorporate a bent sub or a bent motor housing. Alternatively the first motor assembly may have a tubular housing supported by eccentric stabilisers so as to cause the axis of rotation of the drill bit to be tilted relative to the axis of the section of borehole being drilled.

Furthermore the second motor assembly may incorporate a mud motor adapted to be driven by drilling mud passing along the drill string to rotate the first motor assembly.

The apparatus may include at least one articulated constant velocity coupling between the first and second motor assemblies and/or between said assemblies and the drill string.

Figure 2:
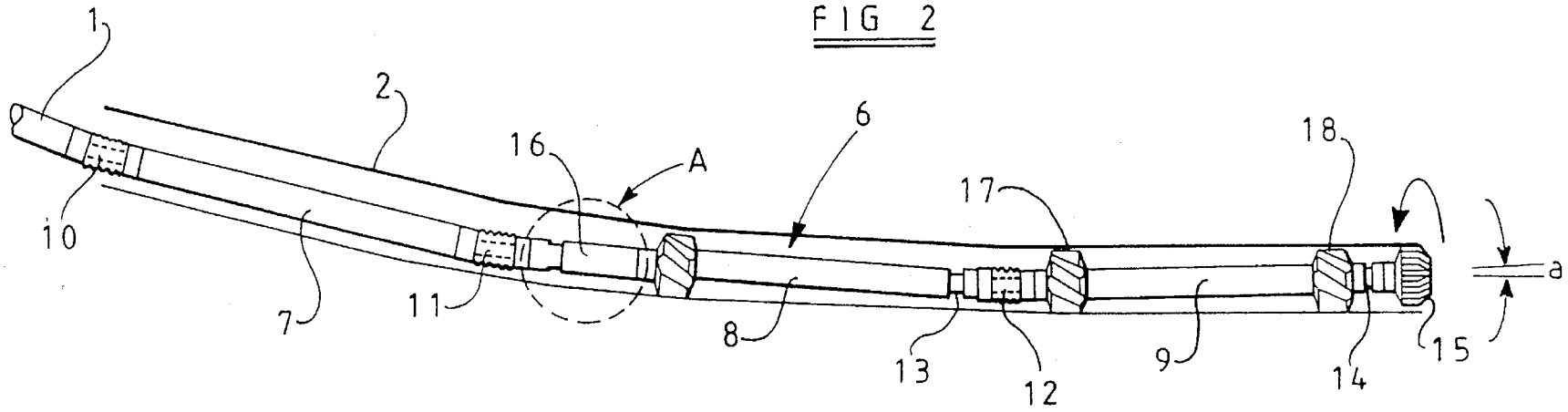
Figure 3:
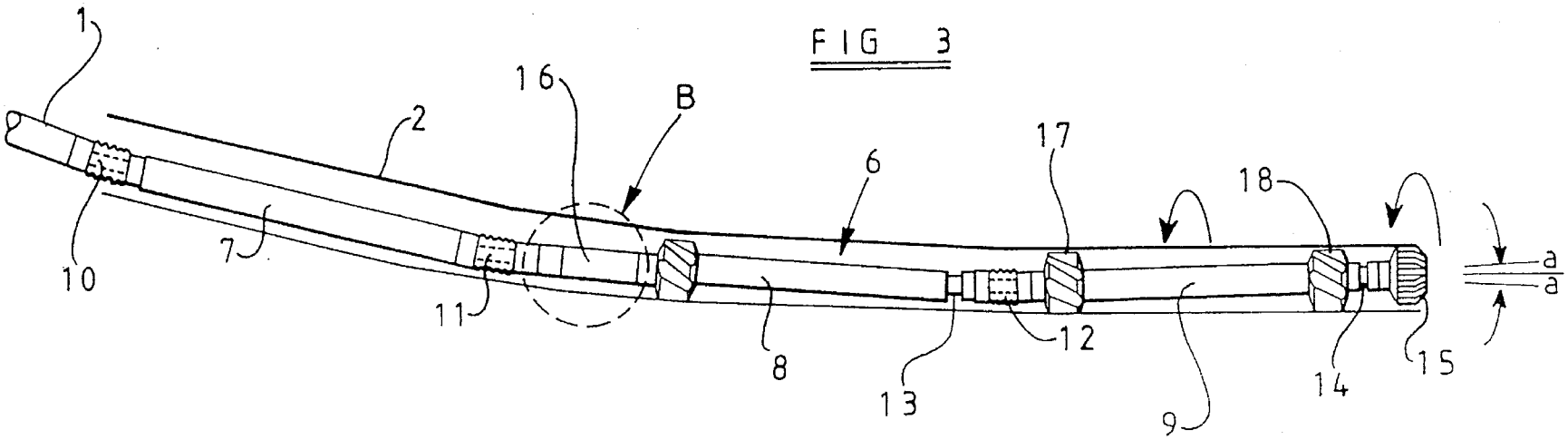
Figure 4:
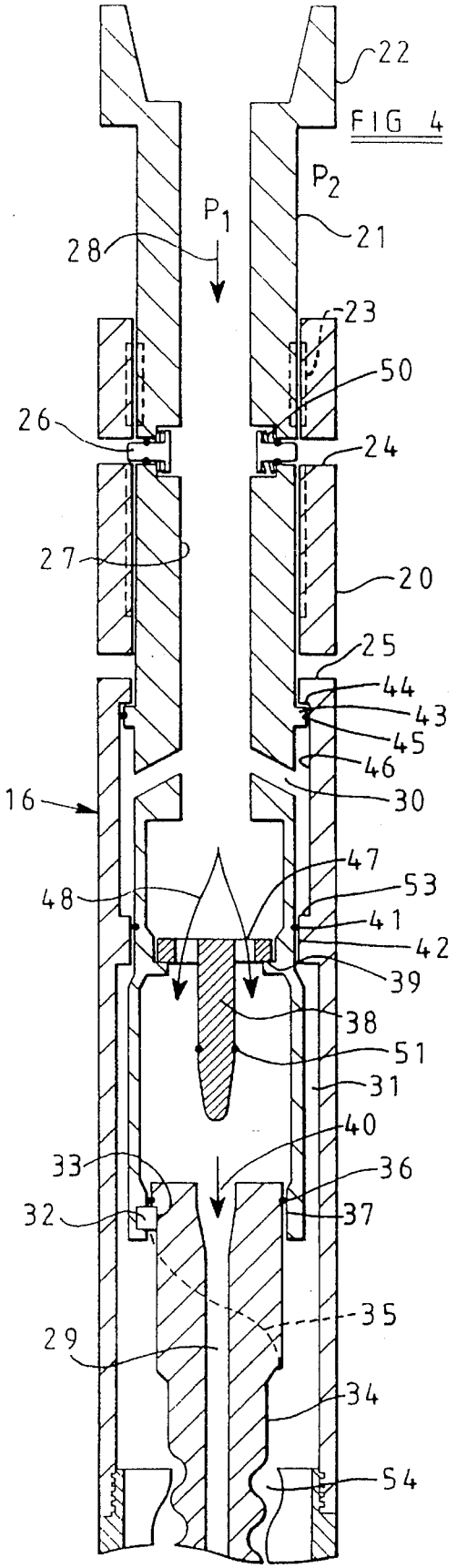
Figure 5:
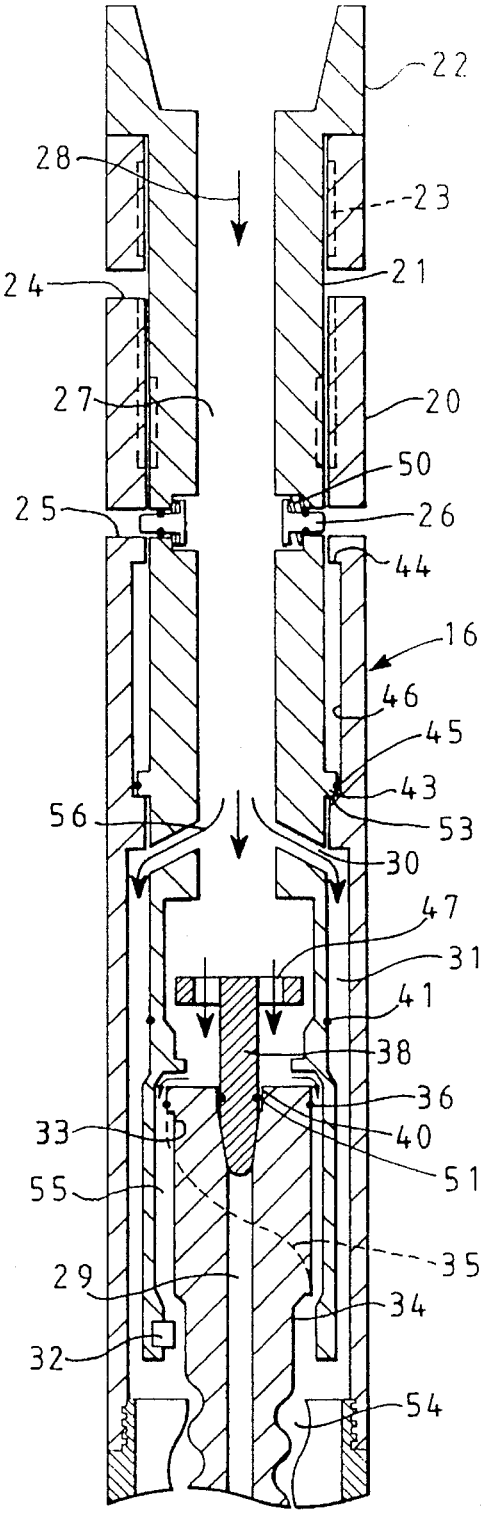

In order that the invention may be more fully understood, a preferred embodiment of the invention will now be described, by way of example, with reference to the accompanying drawings, in which:

FIG. 1 is a broken-away schematic diagram of the apparatus in use for directional drilling of a borehole;

FIGS. 2 and 3 are enlarged schematic diagrams of the apparatus of FIG. 1, respectively in use for curved drilling and straight drilling; and FIGS. 4 and 5 are axial sections through details A and B of the apparatus in FIGS. 2 and 3 respectively.

Referring to FIG. 1 a drill string 1 within a borehole 2 is rotatable by a rotary table 3 mounted on a rig 4 and having a drive/lock system 5 for selectively allowing or preventing rotation of the rotary table 3. Rotation of the drill string 1 by the rotary table 3 may be effected either continuously or over a limited angle in order to orientate the drill string 1 along a predetermined reference direction.

The drill string 1 has a bottomhole assembly 6 comprising three tubular housings, namely an upper housing 7, an intermediate housing 8 and a lower housing 9, and three articulated constant velocity couplings 10, 11 and 12 coupling the upper housing 7 to the drill string 1 and the housings 7, 8 and 9 to each other. Each of the housings 8 and 9 incorporates a respective mud motor (not shown) having an output shaft 13 or 14, and each of the mud motors may be of any conventional type which incorporates a rotor connected by way of a constant velocity joint to the output shaft 13 or 14. The output shaft 13 of the upper motor within the intermediate housing 8 is connected to the constant velocity coupling 12 so that the lower housing 9 and the lower motor accommodated therein may be rotated as a whole by rotation of the output shaft 13. Furthermore the output shaft 14 of the lower motor within the lower housing 9 is connected to a drill bit 15 so that rotation of the drill bit 15 is effected by rotation of the output shaft 14.

The upper housing 7 may contain a downhole steering system, incorporating magnetometers and accelerometers for example, to measure and transmit the surface data indicative of borehole inclination and direction, as well as data indicative of the orientation between a reference line of the upper housing 7 and that direction.

The bottomhole assembly 6 also includes a lock sub 16 between the constant velocity coupling 11 and the intermediate housing 8, and the function of this lock sub 16 will now be described with reference to FIGS. 2 and 3 which show enlarged views of the bottomhole assembly 6 respectively during drilling along a curved path and during drilling along a straight path.

Referring to FIG. 2 the lower housing 9 is supported by first and second stabilisers 17 and 18 and extends through eccentric bores in the stabilisers 17 and 18 which are angularly offset relatively to each other so that the axis of the lower housing 9, and hence also the axis of the output shaft 14, is tilted at an angle a relative to the axis of the borehole. As a result the drill bit 15 is caused to engage one side of the borehole 2 during rotation by the output shaft 14 so that, provided the lower housing 9 is maintained with a fixed axial orientation, drilling is effected along a curve in a direction determined by such orientation, in generally known manner.

In this mode of drilling operation the lock sub 16 is activated so as to provide a fixed angular relationship between the lower housing 9 and a reference line on the upper housing 7, and so as to prevent any rotation of the lower housing 9 by the output shaft 13 of the upper motor. Since this angular relationship may be measured initially at the surface prior to running of the drill string 1 into the borehole 2, it is possible under these conditions by alignment of the drill string 1 (using data from the downhole steering system within the upper housing 7) to orientate the axis of the output shaft 14 in any required direction. The construction and operation of the lock sub 16 in this curved drilling mode will be described below with reference to FIG. 4 which shows an enlarged axial section through the detail A of FIG. 2.

Referring now to FIG. 3 deactivation of the lock sub 16 may be effected to remove the fixed angular relationship between the lower housing 9 and the reference line on the upper housing 7, and to permit the upper motor to be driven by the mud flow so as to rotate the output shaft 13 and so as to in turn cause continuous rotation of the lower housing 9 at the same time as the output shaft 14 and the drill bit 15 are rotated by the lower motor. This causes the mean position of the axis of the output shaft 14 during continuous rotation of the lower housing 9 to be coincident with the axis of the borehole, and means that drilling then proceeds along a straight path so that the existing trajectory of the borehole is maintained. The construction and operation of the lock sub 16 in this straight drilling mode will be described below with reference to FIG. 5 which shows an enlarged axial section through the detail B of FIG. 3.

Referring to FIG. 4 showing the lock sub 16 in the curved drilling mode of operation, the lock sub 16 has a tubular outer casing 20 and a tubular mandrel 21 which is axially movable within the casing 20 and is connected to the constant velocity coupling 11 by an internally screwthreaded collar 22. Rotation of the mandrel 21 within the casing 20 is prevented by drive splines 23 shown in broken lines in the figure. The casing 20 is formed with two axially spaced pairs of locking bores 24 and 25 extending through the wall of the casing 20 and each adapted to receive a pair of locking pistons 26 therein to selectively lock the mandrel 21 within the casing 20 in one of two axially spaced positions. Furthermore the mandrel 21 is formed with a coaxial passage 27 for flow of drilling mud therealong in the direction of the arrow 28 and for supply of drilling mud to drive a rotor 34 of the upper motor by way of branch ducts 30 and an annular space 31 surrounding the mandrel 21, as well as for supply of drilling mud to a rotor bypass duct 29.

Activation of the lock sub 16 may be effected as follows. Initially flow of drilling mud along the drill string is stopped and the drill string is hoisted so that the drill bit ceases to be in contact with the surrounding subsurface rock formations through which the borehole is being drilled. The resulting tensile load on the lock sub 16 causes the mandrel 21 to be drawn out of the casing 20 to the position shown in FIG. 4, thereby engaging a key 32 on the inside of the lower end of the mandrel 21 with a keyway 33 provided on the rotor 34, the key 32 being guided into the keyway 33 by a cam surface 35 (shown in broken lines) on the rotor 34. This also causes an O ring 36 on the rotor 34 to engage a seal area 37 on the inside of the lower end of the mandrel 21. There is only one position in which the key 32 may lock into the keyway 33 so that in the locked position there is a defined orientation of the mandrel 21 with respect to the rotor 34, and this therefore results in a fixed angular relationship between the lower housing 9 and the reference line on the upper housing 7.

The movement of the mandrel 21 into the position shown in FIG. 4 also engages a dart 38 with an annular shoulder 39 on the inside of the mandrel 21, thus causing the dart 38 to be lifted clear of an orifice 40 in the rotor 34 communicating with the rotor bypass duct 29. Furthermore an O ring 41 on the outside of the mandrel 21 contacts a seal area 42 on the inside of the casing 20 shortly before an annular shoulder 43 on the mandrel 21 contacts a shoulder 44 on the inside of the casing 20 to prevent any further upward movement of the mandrel 21. An O ring 45 on the shoulder 43 slides over a seal area 46 on the inside of the casing 20 during all movement of the mandrel 21.

Flow of drilling mud along the drill string is then recommenced and, due to the positions of the seals 41 and 45, the only available flow path for drilling mud through the lock sub 16 is through ports 47 in the dart 38, as indicated by the arrows 48, and along the rotor bypass duct 29. As the mud flow rate increases the differential pressure $P_1-P_2$ across the wall of the mandrel 21 exceeds the preload on locking piston springs 50 so as to cause the locking pistons 26 to extend into the bores 24, as shown for the locking piston 26 on the lefthand side of the figure (although not the locking piston on the righthand side of the figure). The rotary table may then be used to align the drill string to orientate the output shaft 14 in the required direction, the output shaft 14 being rotated by supply of drilling mud along the rotor bypass duct 29. The drill string is then lowered so that the rotating drill bit 15 contacts the surrounding formations and drilling along a curved path is effected.

Referring now to FIG. 5 showing the lock sub 16 in the straight drilling mode of operation, deactivation of the lock sub 16 may take place as follows. The drill string is first hoisted so that the drill bit is no longer in contact with the surrounding formations, and flow of drilling mud along the drill string is stopped. This results in retraction of the locking pistons 26 from the bores 24 under the influence of the locking piston springs 50. The drill string is then lowered so that the drill bit comes into contact with the surrounding formations, and the resulting compressive load causes the mandrel 21 to retract into the casing 20, thus disengaging the key 32 from the keyway 33 and breaking the contact between the O ring 36 and the seal area 37. Furthermore the dart 38 is introduced into the orifice 40 causing an O ring 51 on the dart 38 to seal against the wall of the orifice 40. At the same time movement of the mandrel 21 causes the branch passages 30 to open into the annular space 31 to permit supply of drilling mud thereto, and the shoulder 45 on the mandrel 21 contacts a further shoulder 53 on the inside of the casing to prevent any further retraction of the mandrel 21 into the casing 20.

Flow of drilling mud along the drill string is then recommenced, and, as the flow rate increases, the differential pressure $P_1$–$P_2$ exceeds the preload on the locking piston springs 50 so as to cause the locking pistons 26 to extend into the bores 25, only the lefthand side piston 26 being shown in this position in the figure. Due to the positions of the seals 45 and 51, the only available flow path for the drilling mud is down the space 54 surrounding the rotor 34, such flow taking place both by way of the branch passages 30 and the annular space 31 and by way of the further annular space 55 between the rotor 34 and the inside of the mandrel 21, as indicated by the arrows 56. Thus the rotor 34 is caused to rotate to turn the output shaft 13, and this in turn causes the lower housing 9 to rotate which results in the mean position of the output shaft 14 being coincident with the axis of the borehole. At the same time the output shaft 14 is rotated so that drilling proceeds along a straight path.

The articulated constant velocity couplings 10, 11 and 12 provide points of zero bending moment which limit the stresses induced in the housings 7, 8 and 9 to acceptable levels. By virtue of its greater flexibility, the drill string 1 is better able than the housings 3, 4 and 5 to accommodate changes in borehole trajectory, although it is susceptible to fatigue failure by continuous rotation due to the magnitude and number of cyclic stress reversals associated with such continuous rotation. It is therefore a particular advantage of the bottomhole assembly described above that continuous rotation of the lower housing 9 to effect drilling along a straight path may be achieved without requiring continuous rotation of the drill string.

I claim:

1. Apparatus for steering a drill bit at the end of a drill string within a borehole to selectively effect drilling along either a curved path or a substantially straight path, the apparatus comprising a first downhole motor assembly (9) for coupling to the drill bit (15) and operable to rotate the drill bit to effect drilling, the first motor assembly (9) being arranged to angularly tilt the rotational axis of the drill bit (15) relative to the axis of the section of borehole being drilled, characterised in that the apparatus further comprises a second downhole motor assembly (8) for coupling the first motor assembly (9) to the drill string (1) and operable to rotate the first motor assembly (9), and actuating means (16) for selectively (i) effecting rotation of the drill bit (15) by the first motor assembly (9) while the first motor assembly is maintained at a defined axial orientation so as to cause drilling of the borehole along a curved path in the direction of tilt of the drill bit, or (ii) effecting rotation of the drill bit (15) by the first motor assembly (9) while the first motor assembly is rotated by the second motor assembly (8) so as to cause drilling of the borehole along a substantially straight path.

2. Apparatus according to claim 1, wherein the first motor assembly (9) incorporates a mud motor adapted to be driven by drilling mud passing along the drill string (1) to rotate the drill bit (15).

3. Apparatus according to claim 2, wherein the second motor assembly (8) incorporates a mud motor adapted to be driven by drilling mud passing along the drill string (1) to rotate the first motor assembly (9).

4. Apparatus according to claim 3, wherein the actuating means (16) is actuable to effect locking of a rotor (34) of the second motor assembly (8) with respect to the drill string (1) so as to maintain the first motor assembly (9) at said defined axial orientation for the purpose of drilling along a curved path.

5. Apparatus according to claim 4, wherein the actuating means (16) incorporates an outer casing (20) and a mandrel (21) within the casing, the casing (20) and the mandrel (21) being capable of relative axial movement between a locked position in which the rotor (34) is locked with respect to the drill string (1) and an unlocked position in which the rotor (34) is capable of being rotated relative to the drill string (1).

6. Apparatus according to claim 5, wherein the actuating means (16) incorporates orienting means in the form of complementary formations (32, 33) on the mandrel (21) and on the rotor (34) adapted to determine a defined orientation of the rotor (34) with respect to the mandrel (21) when the actuating means (16) is in the locked position.

7. Apparatus according to claim 6, wherein the actuating means (16) incorporates locking means in the form of preloaded pistons (26) capable of being forced into bores (24, 25) under the action of mud pressure to prevent relative axial movement between the casing (20) and the mandrel (21) when the actuating means (16) is in the locked position and when the actuating means (16) is in the unlocked position.

8. Apparatus according to claim 7, wherein the actuating means (16) incorporates valve means (20, 30, 36, 37, 38) adapted to conduct drilling mud flow to the rotor (34) to drive the rotor (34) when the first motor assembly (9) is rotated by the second motor assembly (8) and to inhibit drilling mud flow to the rotor (34) to prevent driving of the rotor (34) when the first motor assembly (9) is to be maintained at said defined axial orientation.

9. Apparatus according to claim 8, wherein the valve means (29, 30, 37, 37, 38) incorporates at least one lateral passage (30) extending through the wall of the mandrel (21) and arranged to open into an annular space (31) surrounding the mandrel (21) when the actuating means (16) is in the unlocked position for supplying drilling mud to the rotor (34) by way of said annular space (31).

10. Apparatus according to claim 9, wherein the valve means (29, 30, 36, 37, 38) incorporates a bypass duct (29) extending through the rotor (34) and closure means (38) on the mandrel (21) for closing off the duct (29) when the actuating means (16) is in the unlocked position and for opening the duct (29) when the actuating means (16) is in the locked position.

* * * * *